US005555979A

United States Patent [19]

Baas et al.

[11] Patent Number: 5,555,979

[45] Date of Patent: Sep. 17, 1996

[54] PACKING UNIT WITH PACKED ELECTRIC LAMPS

[75] Inventors: Frank J. Baas; Peter G. J. Vos, both of Weert, Netherlands

[73] Assignee: U.S. Philips Corporation, New York, N.Y.

[21] Appl. No.: 103,477

[22] Filed: Aug. 6, 1993

[30] Foreign Application Priority Data

Aug. 17, 1992 [NL] Netherlands ..... 9201462
Oct. 30, 1992 [EP] European Pat. Off. ..... 92203343

[51] Int. Cl.[6] ..... B65D 85/42

[52] U.S. Cl. ..... 206/419; 229/87.01

[58] Field of Search ..... 206/419–422, 206/499; 229/87.01, 87.03, 87.18, 89.91, 40

[56] References Cited

U.S. PATENT DOCUMENTS

| | | | |
|---|---|---|---|
| 1,888,855 | 11/1932 | Fuller . | |
| 2,912,104 | 11/1959 | Fink | 229/40 X |
| 3,391,781 | 7/1968 | Jorgensen | 229/40 X |
| 4,058,211 | 11/1977 | Barbien et al. | 206/422 |
| 4,180,164 | 12/1979 | Durden et al. | 206/419 |
| 4,708,284 | 11/1987 | Sutherland et al. . | |
| 4,744,464 | 5/1988 | Noe | 206/422 |
| 4,844,328 | 7/1989 | Cooper . | |
| 4,860,943 | 8/1989 | Cooper . | |
| 4,878,612 | 11/1989 | Schuster . | |
| 5,180,100 | 1/1993 | Shimizu | 229/40 X |

FOREIGN PATENT DOCUMENTS

| | | | |
|---|---|---|---|
| 952866 | 8/1974 | Canada | 206/419 |
| 8403230 | 2/1984 | Germany . | |
| 1436166 | 5/1976 | United Kingdom . | |
| 1512521 | 6/1978 | United Kingdom . | |

*Primary Examiner*—Bryon P. Gehman
*Attorney, Agent, or Firm*—Ernestine C. Bartlett

[57] ABSTRACT

The unit comprises a tray (3) carrying block-shaped cartons (1), arranged in rows (6), in which electric lamps (2) are accommodated. A wrapper (10) having a closure is folded about folding lines (11) so as to surround a base wall (4) and first side walls (5*a*) of the tray (3), and the side (7) of the cartons (1) remote from the base wall (4). The wrapper (10) encloses the package (1, 3) with clamping force. The unit has important advantages such as easy packing and unpacking, small material requirement, and visibility of the contents of the wrapper. A sticker (42) may be present over the closure of the wrapper, indicating that the wrapper has not been opened. A sticker (42) in combination with flaps (45'), which are integral with second side walls (5*b*) and fastened to the first side walls (5*a*) of the tray (3), and in combination with recesses (40) in the wrapper (10) with which the flaps cooperate, provides an indication that the contents of the unit have not been tampered with.

18 Claims, 8 Drawing Sheets

PACKING UNIT WITH PACKED ELECTRIC LAMPS

FIELD OF THE INVENTION

The invention relates to a packing unit with packed electric lamps, comprising:

cartons of a rectangular block shape, in each of which at least one electric lamp is present;

a rectangular tray with a base wall and mutually opposing first and mutually opposing second side walls which are interconnected and extend from this base wall, which tray is filled with a plurality of cartons arranged in rows; and an outer envelope which is provided with a closure and in which the tray with said cartons is accommodated.

BACKGROUND OF THE INVENTION

Such a packing unit is known from DE GM 84 03 230.

The outer envelope in the known unit is an outer box. The tray is placed therein in order to form a second layer of cartons on a first layer of cartons which are arranged separately in the outer box. The outer box is closed at its lower side and at its upper side by means of partly overlapping flaps which are fixed in closed position with adhesive tape. The outer box has in its side walls perforation lines and tear-off strips which merge into one another to facilitate the removal of its upper side and portions of its side walls and to render the cartons with lamps of the upper layer accessible.

It is a major disadvantage of the known unit that voluminous remainders of packaging material are created, which cannot be worked into flat remainders except with great difficultly, both during opening of the outer box and after all cartons have been removed therefrom. Another major disadvantage is the comparatively large quantity of material required for the outer box with its overlapping bottom and lid flaps. A further disadvantage is that the blank of the box must first be shaped into a sleeve through connection of a first side wall to a last side wall before the outer box can be finally shaped. The box can only be used for accommodating the cartons with lamps inside after it has been given its final shape by closing of the bottom. The cartons present on a tray in the outer box must also be put in the outer box one by one, because no space is available along the sides of the outer box in the case of a rattle-free packaging for holding a filled tray and putting it in the box in one operation.

Another disadvantage of the known unit is that the cartons of the lower layer can only be removed from the outer box one by one initially. This is inconvenient especially where remainders of the outer box at the point of sale or use are not acceptable, for example, because voluminous remainders of packaging material result therefrom in the end.

U.S. Pat. No. 1,888,855 (1932) discloses a packing unit in which six upright open sleeves each with an electric lamp are passed into a cardboard sleeve which is lying on one of its sides. Tags are stamped from the cardboard sleeve which project into the outermost sleeves with lamps and fix said sleeves. This unit is not suitable for displaying a comparatively large number of lamps conveniently and quickly for sale or use.

SUMMARY OF THE INVENTION

It is an object of the invention to provide a packing unit of the kind described in the opening paragraph which requires comparatively little packaging material while nevertheless keeping the canons securely fixed. It is also an object of the invention to provide a packing unit in which a tray with canons, also called "package" hereinafter, can be readily introduced into and taken from the outer envelope. It is also an object to provide a packing unit whose outer envelope can be readily obtained from a flat, pre-shaped piece of material and can be readily converted into a flat piece of material after use.

This object is achieved in a packing unit of the kind described in the opening paragraph in that the outer envelope is a wrapper which is folded about parallel folding lines, and which is wrapped only around the base wall, around the first side walls of the tray and around a side of the canons facing away from the base wall, and which encloses the tray with the canons with clamping force.

The outer envelope surrounds only four of the six sides of the package formed by a tray with the cartons placed therein. As a result, only a small quantity of packaging material is used for the wrapper, also because overlapping flaps at a base side of the outer envelope (as present in an outer box) are absent here.

The unit is readily assembled in that the tray with cartons is placed on the blank of the wrapper and the wrapper is wrapped around this package and closed. The three-dimensional shape of the outer envelope accordingly is not created until the cartons are present. Similarly, the package is readily unpacked, for example, by opening the closure of the wrapper. A flat remainder of the wrapper, for example the blank, results therefrom.

The package may be divested of the wrapper at the point of sale or use itself, if no further transport of the package is necessary. The package may then be put, for example, on a shelf in one operation and the cartons may be taken out as required.

An advantage of the unit is that the wrapper needs no printing for indicating which kind of lamp it contains if the cartons themselves already have this identification. In fact, portions of the cartons extending above the second side walls of the tray are open to view in the faces of the package not covered by the wrapper.

The wrapper encloses the tray with the cartons with clamping force. For this purpose the wrapper has an underdimension relative to the package. Spacings between the folding lines of the wrapper are slightly smaller than the lengths to be covered by the wrapper during packaging. Thus sufficient friction can be obtained between the wrapper and the package, in spite of smooth surfaces of the two components, to ensure that the wrapper securely holds on to the package. It will be clear to those skilled in the art what underdimension is to be given to the wrapper in each individual case in order to achieve a clamping force.

Although the package comprises a tray with a plurality of cartons, and this package is surrounded with clamping force by the wrapper, it is easy to create the unit because the outer envelope need not be shaped until the moment the package is present. Thus it can be avoided not only that friction is to be overcome with the package when the unit is being made, as when the package were to be passed into the interior of a sleeve, but also that each carton could be caught up against the sleeve upon the approach of the latter and would have to be inserted separately. The clamping force exerted by the wrapper on the package indeed implies that the cartons are present in the wrapper in a slightly compressed shape. If a sleeve were used, they would have to be compressed from outside before being able to enter this sleeve.

In a preferred embodiment, a second package is present in the sleeve on the cartons of the tray. An advantage of this embodiment is that the wrapper of this embodiment requires less packaging material than wrappers for separately wrapping the same number of packages would require together.

Another advantage of a unit with a second package is the increased stacking possibility of the unit, for example, on a pallet. It is preferred to lay the unit according to the invention on one surface of the wrapper with the base wall of the tray in vertical position. The mass of a second and of subsequent units placed thereon is then partly supported by the base wall of the tray. If only one tray with cartons is present in a wrapper, the unit lying on its side may have a greater height at the area of the tray, owing to the first side walls of the tray, than at its side remote from the tray. Units stacked in identical positions might form a leaning stack. It is true that units stacked in alternate positions would form a straight stack, but the stacking possibility is limited by sloping upper surfaces which could lead to shifting of the units. If a second tray is present in the unit, the unit has a second area with the same dimension as the area of the first tray. If units are stacked lying on their sides in the same position, a stable, straight stack is obtained with substantially horizontal intermediate planes between the units. Also, each tray adds a stiffened area to the unit.

It is noted that wrappers in which several articles of various kinds are packed have long been known in various shapes and with many kinds of closures. Windows are present in these wrappers through which projections of the articles stick out. These projections, portions of the articles having a comparatively large lateral dimension or a comparatively great longitudinal dimension, render it possible for the wrappers to keep the articles closed in by means of the windows which are adapted to their shapes. The articles and the wrapper form mutually interlocking structures. GB 1 436 166 describes a wrapper with, for example, bottles, GB 1 512 521 a wrapper with tubs having rims directed to the exterior, filled with foodstuffs, U.S. Pat. No. 4,708,284 a wrapper with bottles, U.S. Pat. No. 4,844,328 a wrapper with cups, as does U.S. Pat. No. 4,860,943, and U.S. Pat. No. 4,878,612 a wrapper with tubs.

The conventional block-shaped cartons used for packing individual or several lamps do not have such projections.

Preferably the wrapper and the tray, and also the cartons are made of a material based on the same raw material, for example, cellulose fiber, such as cardboard, for example, duplex or triplex cardboard, corrugated cardboard such as, for example, mini-corrugated cardboard. In a preferred embodiment, the tray is made of duplex cardboard or, if a comparatively great stiffness is required or comparatively heavy lamps are packed, for example, of mini-corrugated cardboard. The wrapper in a preferred embodiment consists of corrugated cardboard, for example, mini-corrugated cardboard, also because of its stiffness and its favourable buffering action. The cartons of the lamps may be made of, for example, duplex cardboard or of corrugated cardboard such as mini-corrugated cardboard.

The closure of the wrapper may be of various kinds. A closure of adhesive tape which interconnects overlapping or mutually facing end portions of the wrapper is convenient. Other closures are known, for example, from the patent documents cited above which describe wrappers which together with the packed articles provide an interlocking structure as a result of their shapes.

An advantageous closure is found in a wrapper which has a furcate shape with teeth at a first end portion and a forward projecting tongue at a second end portion. These end portions may lie together along an identical surface of the package. The teeth at the first end portion and the tongue at the second end portion then lie inside the wrapper, i.e. the teeth between the second end portion and the package, and the tongue between the first end portion and the package. As a result, the end portions clamp in one another's extremities. The clamping force is greatest when, in a particular modification, the teeth and/or the tongue extend substantially to the adjacent folding line. For easy closing it is preferred that the teeth on the one hand and the tongue on the other hand are of unequal lengths. Preferably the tongue is shorter than the teeth. The second end portion can then already lie on the teeth of the first end portion before the tongue has arrived at the first end portion. The tongue is then pressed inwards, while the end portions are being moved further towards one another and the tongue slides quasi automatically below the first end portion. Surfaces of the wrapper to which the end portions are connected along folding lines may then be moved further towards one another so as to form the unit.

In a modification of this closure, the tongue has a portion which widens towards the second end portion beyond the interspacing between the teeth. As a result the tongue can initially slide smoothly between the teeth, but subsequently centers itself relative to the teeth by means of its widening portion. The lateral contact of the tongue with the teeth further contributes to the forces which keep the wrapper closed.

A wrapper with an alternative advantageous closure has a first and a second toothed end portion, the teeth becoming narrower towards their free ends. It is especially preferred that the end portions each have an incision between the teeth, and the incision of the one end portion engages that of the other end portion. The narrowing portions of the teeth form guides towards said incisions. Not only does a tooth of the one end portion end up below the other end portion and vice versa, so that the wrapper is already closed, but this closure has the additional advantage that the material of the one end portion is held clamped in the incision of the other end portion and vice versa. In a modification of this embodiment, each end portion has multiple teeth, for example, three teeth. In this modification the closing force of the closure is further enhanced. It is also preferred for easy closing of the wrapper with this closure and its modification that a tooth, for example the central tooth in the case of three teeth, is shorter than the other ones.

The closures of the two preceding paragraphs have the advantage that threading of tongues through eyelets or slots, which has to be done in known closures, is avoided. Not only is the wrapper readily closed without additional means, but it can also be readily opened again, non-destructively and without tools. A finger hole may be present in each of the end portions, into each of which a finger may be inserted so as to move the end portions apart.

A seal may be provided over the closure if it is desirable for the end user of the unit to be able to ascertain that the wrapper has not been opened during transport of the unit from the factory. The wrapper cannot be opened then without breaking the seal. A seal may consist, for example, of an adhesive tape made of, for example, cellulose material, possibly imprinted, for example, with a brand name, a recycling symbol, etc.

An unbroken seal does indicate that the wrapper has not been open, but the tray with the cartons could have been partly pushed from the wrapper to the outside, though this would require force, robbed of a few cartons, and have been returned with difficulty to the interior again, eventually with dummy filling material.

This risk is counteracted in a preferred modified embodiment. In this embodiment, flaps are present at the second side walls, gripping around the first side walls and fastened thereto so as to interconnect these side walls. These flaps then project from the first side walls. In this embodiment, recesses are present in the wrapper in which the flaps are accommodated. In this case, for example, a tongue may be cut out which may remain inside the wrapper, so that no material need be removed for this. The flaps then project into an outer contour thereof, thus inhibiting a displacement of the tray.

Alternatively or in addition, the material of the wrapper may be locally flattened, the flattened portion acting as a recess. An advantage of this is that this need hardly be visible at the outside of the wrapper at a cursory glance. The combination of a cut-out and also flattened tongue has the advantage that the outer contour of the tongue forms a hard, discrete stop for a projecting portion, for example a flap, at a first side wall.

Preferably for the cooperation between tray and wrapper, when made from (mini-)corrugated paperboard, the corrugations in the flaps extend along the base wall. The flap surface which is to cooperate with the recess in the wrapper is then less likely to become deformed than if the corrugations therein were to extend transverse to the base wall.

It is preferred that the closure of the wrapper is present in a surface remote from the base wall of the tray. Unevennesses caused by overlaps in the surface having the closure will then lie in a side surface when the units are stacked lying on their sides, so that a stable stacking, for example on a pallet, can be obtained. The closure in this surface is also preferred in a unit containing more than one package. The packages are then pulled and held against one another by the relevant dimensioned wrapper surfaces which are integral.

The packed electric lamps may be incandescent lamps or discharge lamps of various kinds.

BRIEF DESCRIPTION OF THE DRAWINGS

Embodiments of the packing unit according to the invention are shown in the drawing, in which.

DETAILED DESCRIPTION OF THE PREFERRED EMBODIMENT

Figure 1:
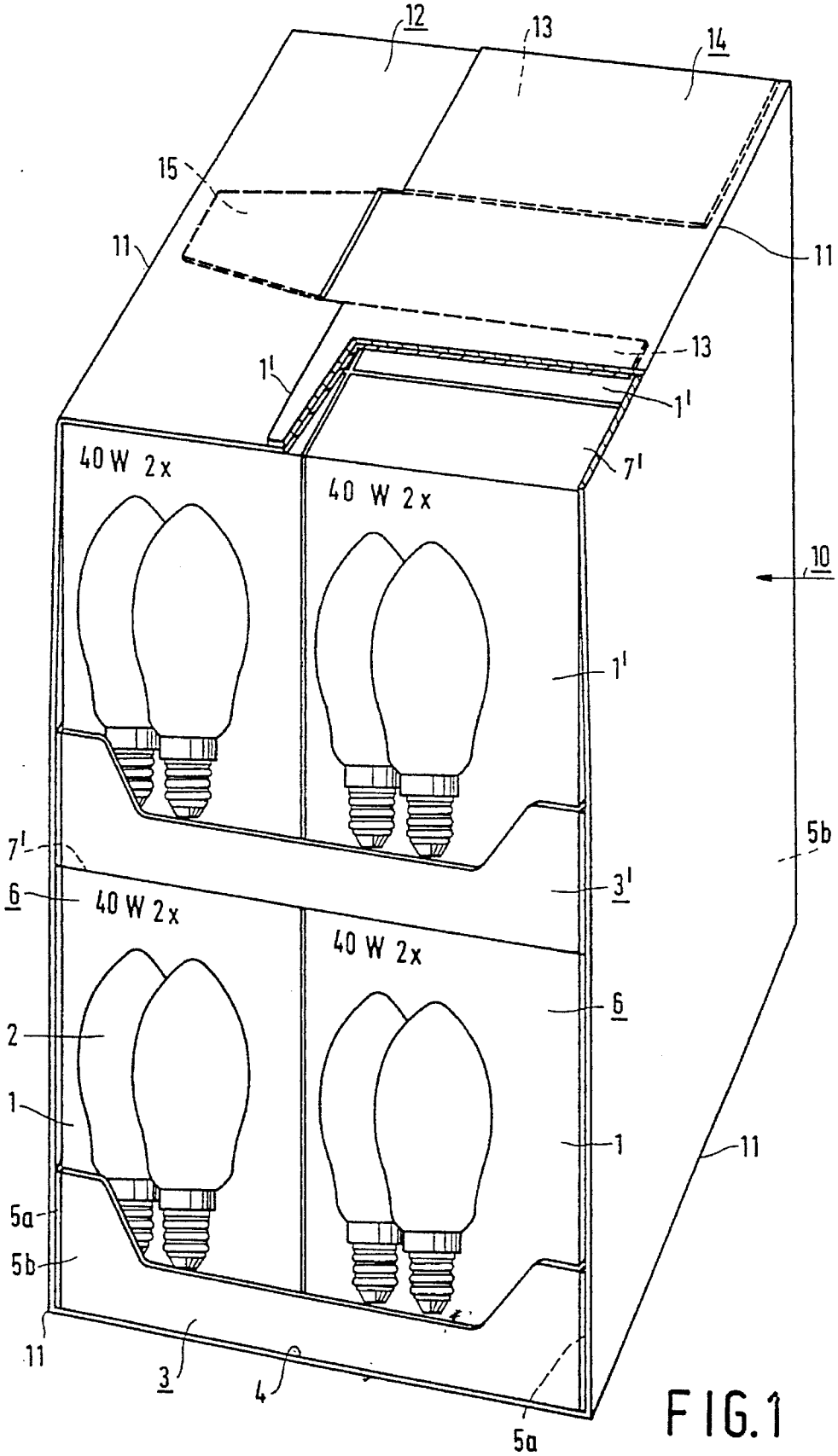
FIG. 1 is a perspective view of the packing unit, partly broken away.

In FIG. 1, the packing unit with packed electric lamps comprises cartons 1 of a rectangular block shape, in each of which at least one electric lamp 2 is present, a tray 3 has a rectangular base wall 4 and, extending therefrom and interconnected, mutually opposing first side walls 5*a* and mutually opposing second side walls 5*b*. The tray is filled with a plurality of cartons arranged in rows 6. The unit has an outer envelope 10 which is provided with a closure and in which the tray with said cartons is accommodated.

In the unit, the outer envelope 10 is a wrapper which is folded about parallel folding lines 11, which is wrapped around the base wall 4, around the first side walls 5*a* of the tray 3 and around a side 7 of the cartons 1 facing away from the base wall, and which encloses the tray 3 with the cartons 1 with clamping force.

In the Figure, the cartons are arranged in two rows. The cartons, made of duplex cardboard in the Figure, each contain two incandescent lamps. The frontmost side wall of the tray, made of mini-corrugated cardboard in the Figure, is reduced in height so as to afford a view of the lamp cap of the lamp pictured on the cartons. The unit displays in the position shown, and also from behind, which kind of lamp is packed therein while the wrapper is still closed.

In the unit shown, a second tray 3' filled with cartons 1' is present on the cartons 1 of the tray 3 in the wrapper 10.

The wrapper 10 (see also FIG. 2), made of corrugated cardboard in the Figure, has a first end portion 12 with teeth 13 and a second end portion 14 with a forward projecting tongue 15, which tongue 15 projects between the teeth 13, while the tongue 15 and the teeth 13 lie inside the wrapper. This closure of the wrapper is self-fixing.

The fixation of the closure is further enhanced in that the teeth 13 extend to close to the adjacent folding line 11 of the wrapper 10, as does the tongue 15.

The tongue 15 is shorter than the teeth 13 (FIG. 2), so that the wrapper can be readily closed. When the first end portion 12 has been wrapped around the package, the second end portion 14 can already rest on the teeth 13 before the tongue 15 has arrived at the first end portion 12. As a result, the tongue can be easily brought below the first end portion when the end portions are moved towards one another so as to close the wrapper.

The trays with cartons containing lamps may be put on the surface 16 of the blank. Then the surfaces 17 are folded upwards about folding lines 11. The surfaces 17 will then enclose the tray 3 with clamping force. The first end portion 12 is folded over the side 7' of the cartons 1' and the second end portion 14 is laid on the first end portion. While the tongue 15 is being pressed inwards and passed below the first end portion, the surfaces 17 are moved further towards one another. The two packages 1, 3; 1', 3' are then pressed onto one another. The surfaces 17 will press against the packages laterally, e.g. against the trays thereof. When the wrapper is closed, it will hold the packages clamped in.

Figure 3:
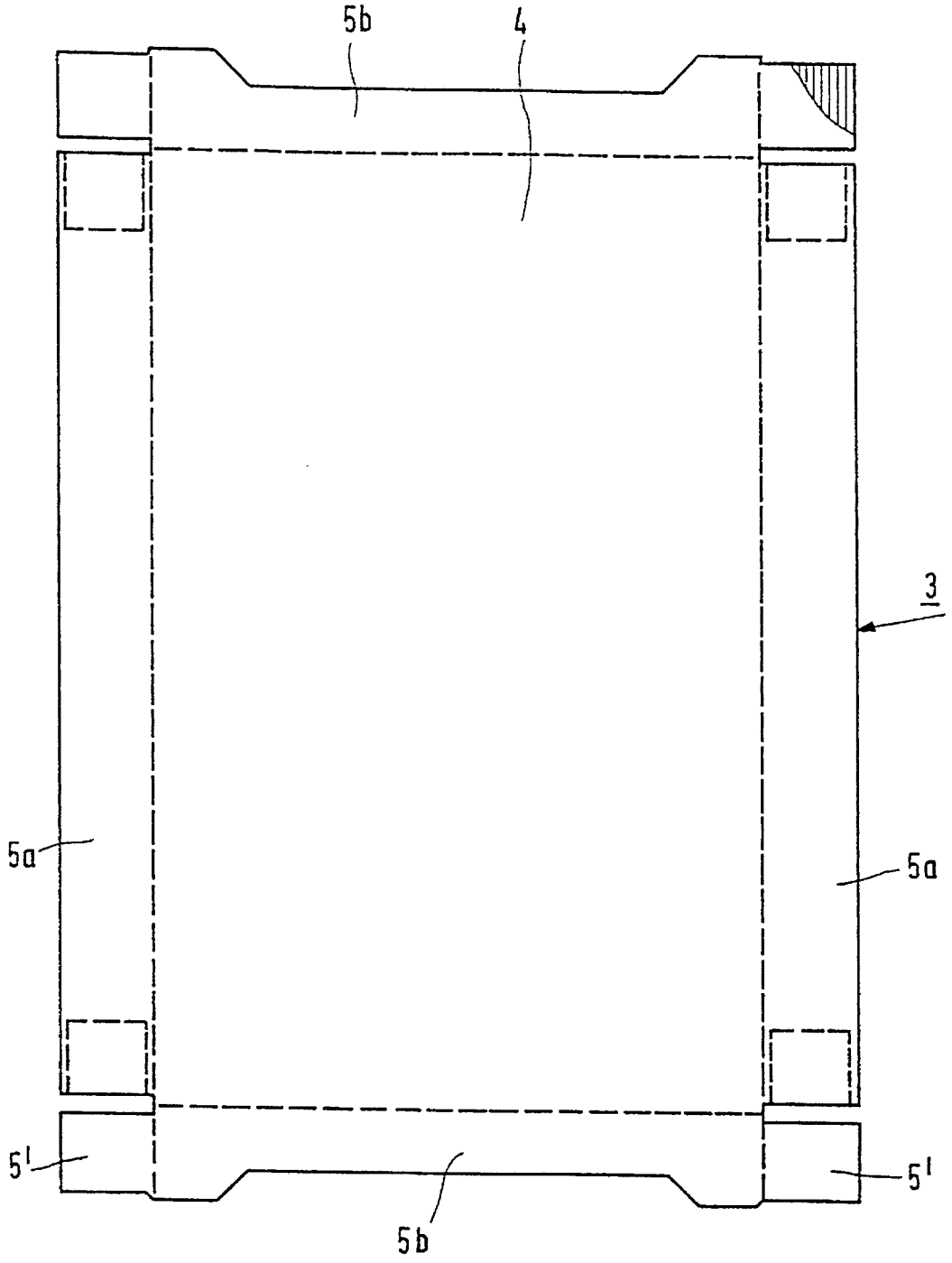
FIG. 3 shows the blank of the tray of FIG. 1.

The tray 3 may be readily folded from the blank of FIG. 3, for example with glue such as, for example, a hot-melt glue. Flaps 5' are present for this purpose.

Figure 4:
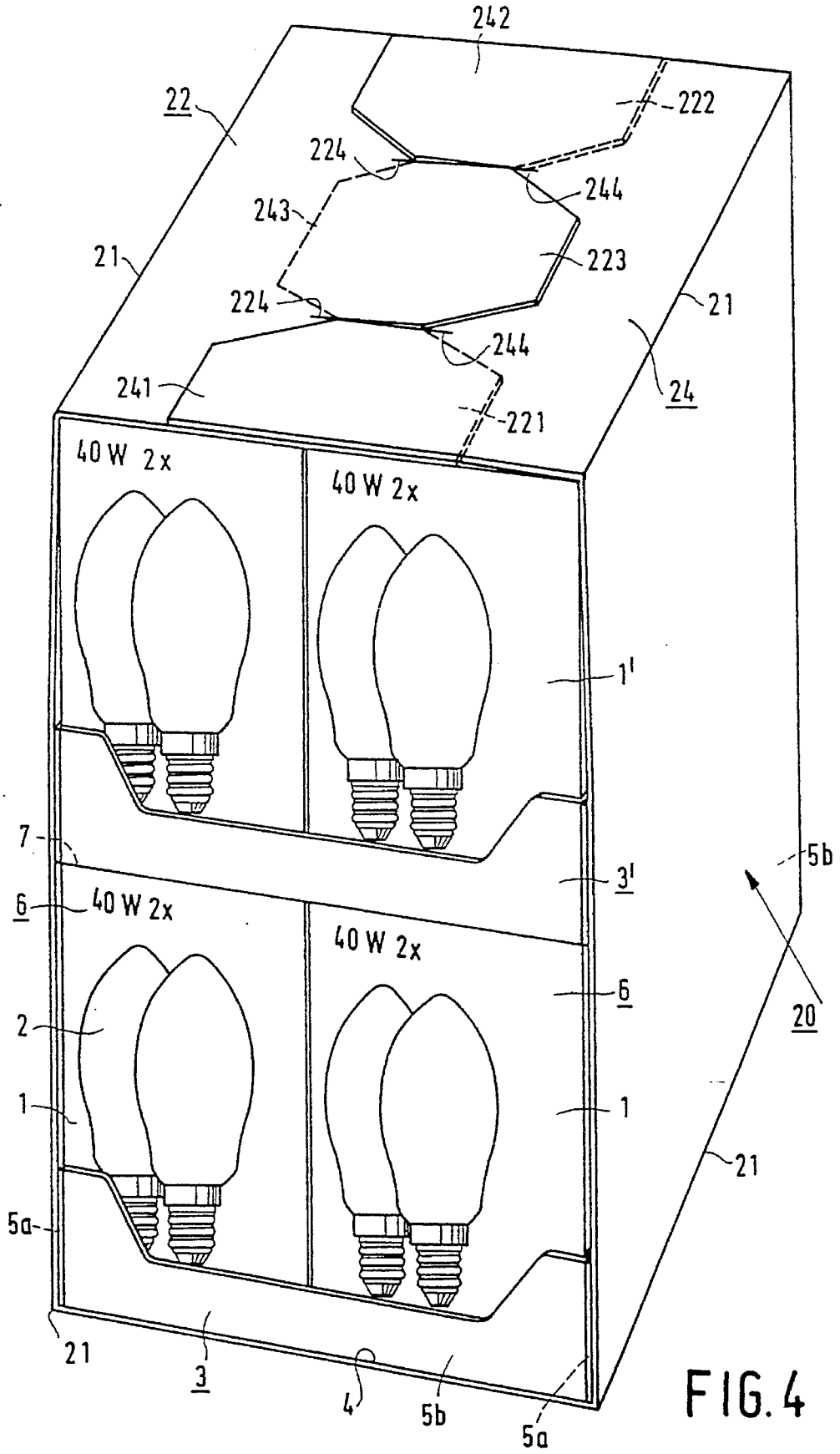
FIG. 4 shows an alternative embodiment of the unit in perspective view.
Figure 5:
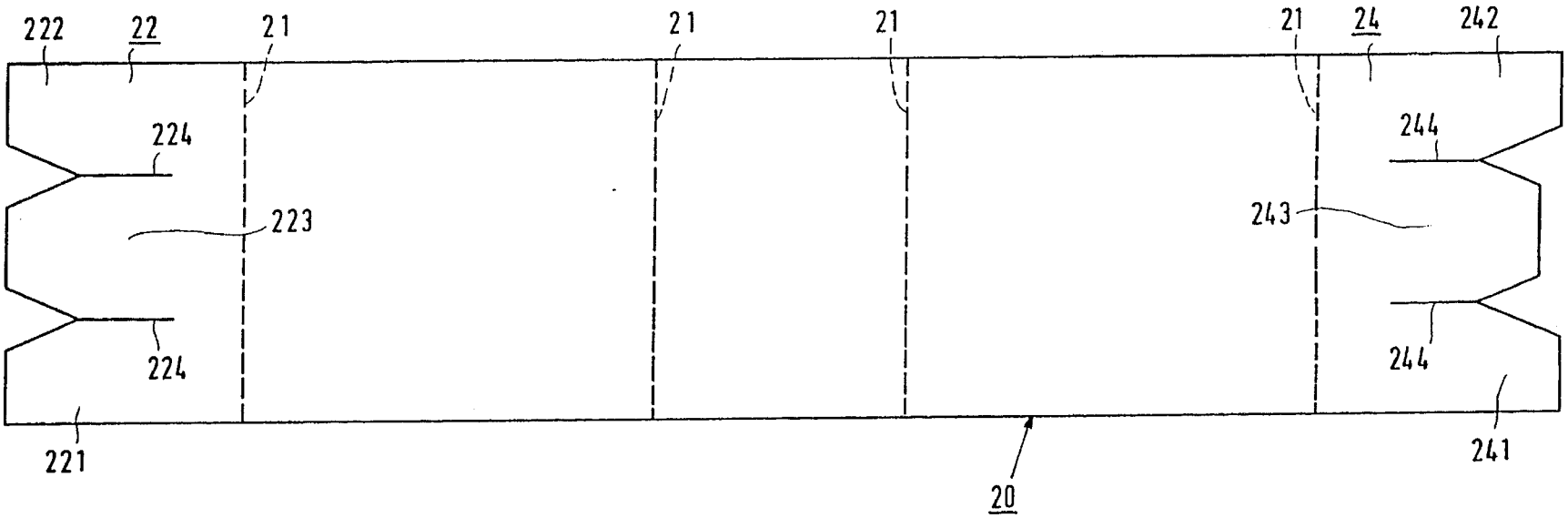
FIG. 5 shows the blank of the wrapper of FIG. 4.

In FIGS. 4 and 5, the trays and cartons used are identical. The wrapper 20 has portions with reference numerals which are 10 higher than in FIGS. 1, 2, i.e. a first end portion 22 and a second end portion 24, each with a first tooth 221, 241 and a second tooth 222, 242 which each become narrower towards a free end thereof. In the first 22 end portion and in the second end portion 24, there is an incision 224, 244 between the teeth 221, 222; 241, 242. The incisions engage one another (FIG. 4).

A third tooth 223, 243 is present in both end portions 22, 24 between the first and second teeth 221, 222; 241, 242. The third tooth 243 in the second end portion 24 is shorter than the first and second teeth 241, 242. This renders it easy to close the wrapper, folded about folding lines 21, as is the case for the wrapper of FIG. 1.

The narrowing teeth form funnels between themselves, so that the teeth of the first end portion guide the teeth of the second end portion and the incisions engage one another quasi automatically.

Figure 6:
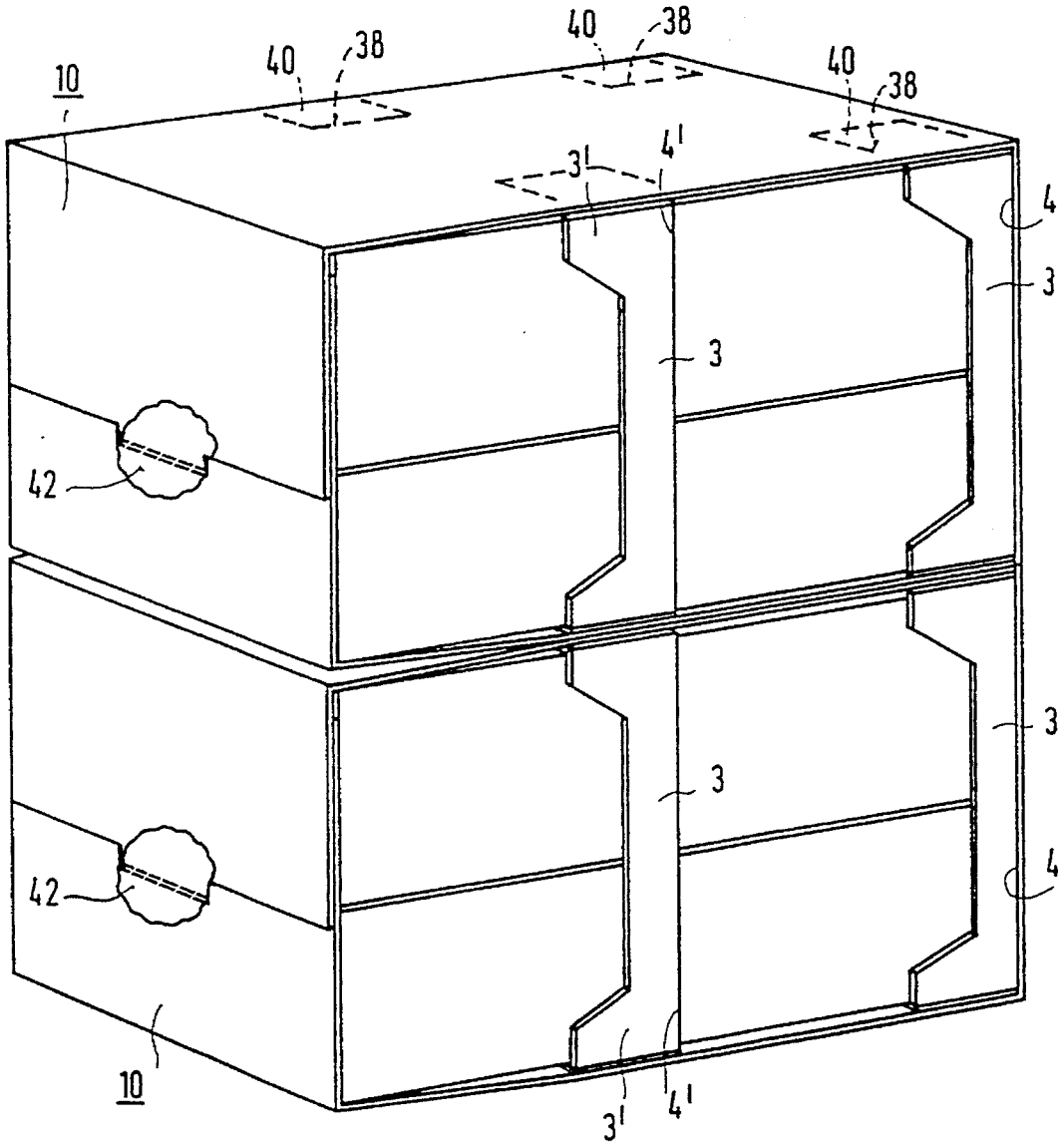
FIG. 6 shows the stacked units in perspective view.

In the drawings, the first and the second end portion 12, 14 and 22, 24, respectively, are remote from the base wall 4, 4' of the tray 3, 3'. The units as a result can be well stacked lying on a surface (17 in FIG. 2) of the wrapper with the base walls 4, 4' in vertical position, as shown in FIG. 6.

The wrappers 10 of the units each have on their closures a seal 42, for example of self-adhesive paper, which shows that the wrapper has not been opened. Incisions 38 may have been provided in the upper surface of the stack. These may (see FIGS. 7 and 8) define recesses into which flaps of trays may project, whereby it is counteracted that trays can be pressed from the wrapper to the exterior.

Figure 2:
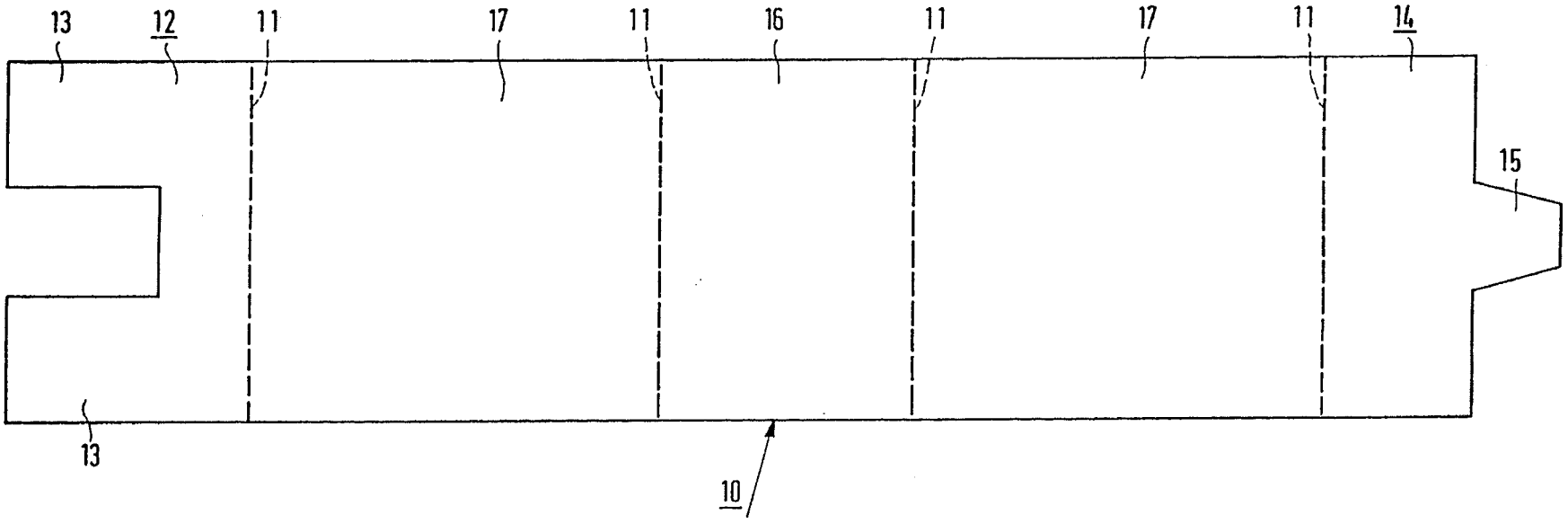
FIG. 2 shows the blank of the wrapper of FIG. 1.

Reference numerals in FIG. 7*a* are 20 higher than those denoting corresponding parts in FIG. 2.

The tongue 35 has a portion 35*a* which widens towards the second end portion 34 beyond the interspacing between the teeth 33. The tongue 35, and with it the second end portion, is thus centred relative to the first end portion 32 when the wrapper is closed. In addition, the tongue is laterally clamped in between the teeth during this, which further increases the forces which keep the wrapper closed.

The wrapper in the Figure has recesses 40 which comprise tongues 39 cut out by means of incisions 38. The recesses could cooperate with flaps of a tray. These flaps (cf. FIG. 8) could press the tongues outwards. In the Figure, however, the tongues are flattened, as is an adjoining portion of the wrapper, this being jointly indicated with the reference numeral 40 and shown hatched. Such flattened portions are also present in the wrapper of FIG. 6. They may have the result that, as is shown in FIG. 6, apart from the incisions 38 the wrapper hardly shows any sign of the coupling between the wrapper and the trays. The tongues have remained inside the wrapper.

FIGS. 7*b* and *c* show that the wrapper has a well-defined, discrete and hard stop 41 for projecting portions of the trays. The wrapper shown is designed for accommodating two trays, each filled with two rows of five closed cartons of rectangular block shape holding an electric lamp. The tongue 35 is then pressed onto the central carton of a row, the teeth onto the adjoining cartons of the other row. Tongue and teeth are then securely fixed by the cooperating end portions and by the cartons with packed lamps.

Figure 7:
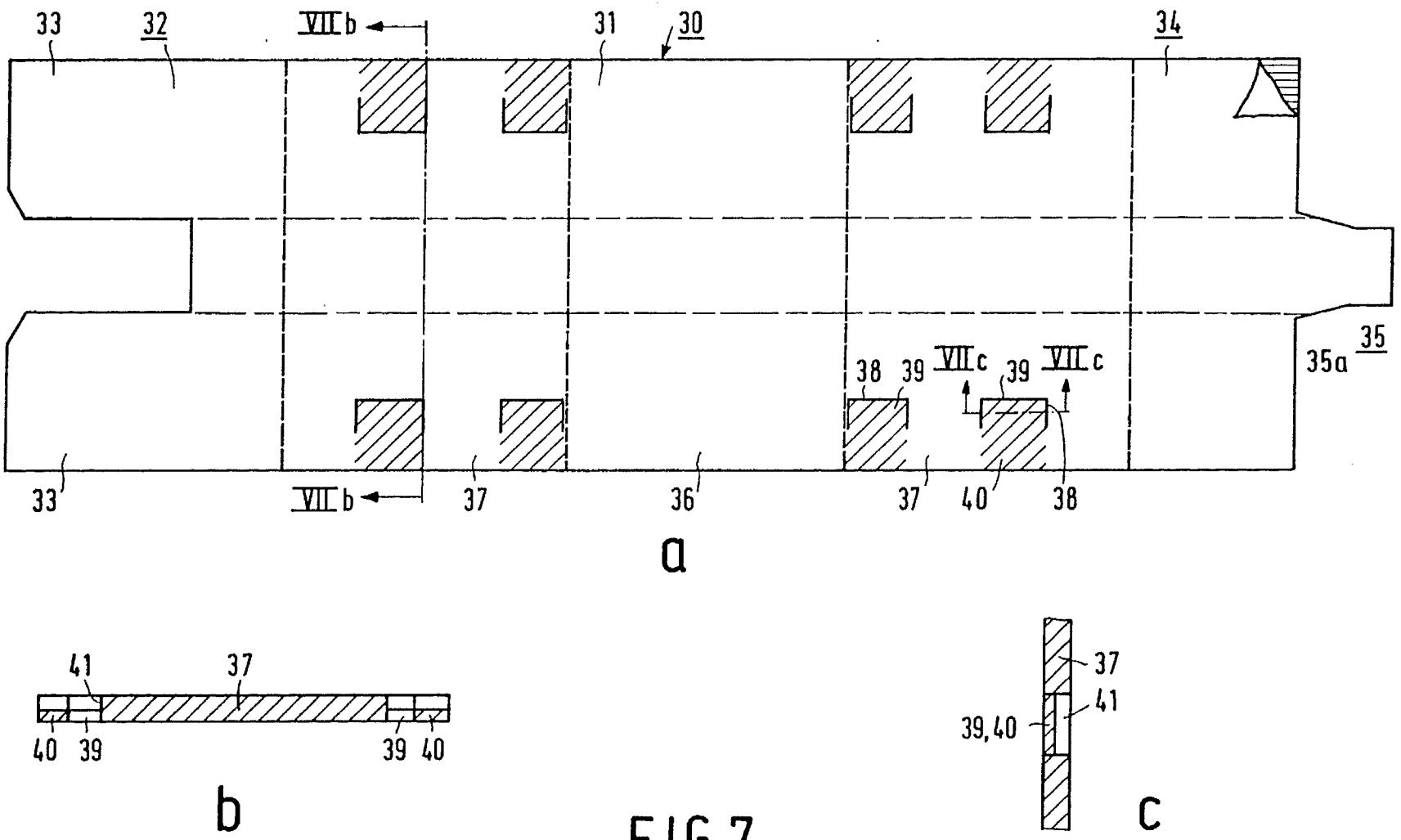
FIG. 7 shows a modification of the blank wrapper of FIG. 2 in elevation (FIG. 7*a*) and in cross-sections taken on the lines VIIb and VIIc (FIGS. 7*b* and 7*c*)
Figure 8:
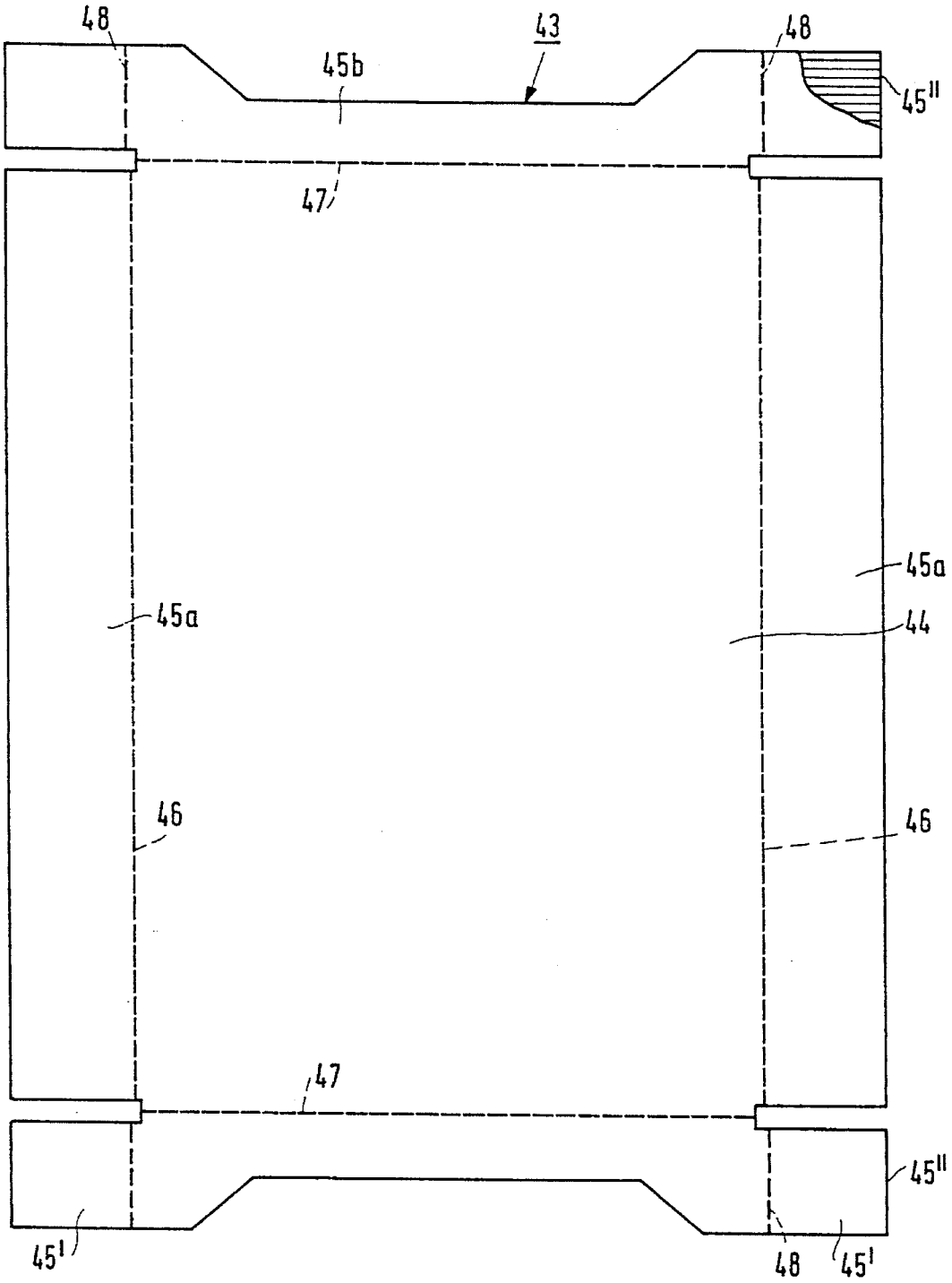
FIG. 8 shows a modification of the tray blank of FIG. 3 for use in conjunction with the blank of FIG. 7.

In FIG. 8, parts have reference numerals which are 40 higher than those of corresponding parts in FIG. 3. For shaping a tray, first the first side walls 45*a* are folded up about folding lines 46, then the second side walls 45*b* about folding lines 47, after which the flaps 45' are folded about folding lines 48 against the outsides of the first side walls and fastened thereto. The folding lines 48, accordingly, lie farther apart than do the folding lines 46. Also because of the direction of the corrugations of the mini-corrugated paperboard used, parallel to the base portion 44, the flaps 45' each have a sturdy end face 45" which can abut against the stop 41 (FIGS. 7*b* and *c*) of the wrapper. In the finished packaging, therefore, there is a good coupling between tray and wrapper which counteracts an unauthorized outward displacement of a tray. If this has nevertheless occurred through the use of force, it will be apparent from deformations in the packaging material.

When the wrapper and the tray formed from the blanks of FIGS. 7 and 8 are used, the second side walls 45*b* will have flaps 45' which grip around the first side walls 45*a* and are fastened thereto, while the wrapper 30 has recesses which cooperate with these flaps.

We claim:

1. A packing unit with packed electric lamps comprising a plurality of cartons (1) of a rectangular block shape, in each one of which cartons at least one electric lamp (2) is present:

a tray (3) with a rectangular base wall (4) and mutually opposing first side walls (5*a*) and mutually opposing second side walls (5*b*) which first and second walls (5*a* and 5*b*) are interconnected and extend from the base wall (4), which tray is filled with said cartons, an outer envelope (10) which outer envelope is provided with a closure and in which outer envelope the tray filled with said cartons is accommodated, the improvement wherein the outer envelope (10) is a wrapper which is folded about parallel folding lines (11) and is wrapped only around the base wall (4), of the tray (3), around the mutually opposing first side walls (5*a*) of the tray (3) and around sides (7) of each of the cartons (1) facing away from the base wall and which encloses the tray (3) and the cartons (1) with a clamping force.

2. A packing unit as claimed in claim 1, characterized in that a second tray (3') filled with cartons (1') is present on the cartons (1) of the tray (3) in the wrapper (10).

3. A packing unit as claimed in claim 1 characterized in that the closure is present in a surface remote from the base wall (4) of the tray (3).

4. A packing unit as claimed in claim 1 characterized in that a seal (42) is present over the closure.

5. A packing unit with packed electric lamps comprising a plurality of cartons (1) of a rectangular block shape, in each one of which cartons at least one lamp (2) is present:

a tray (3) with a rectangular base wall (4) and mutually opposing first side walls (5*a*) and mutually opposing second side walls (5*b*), which first side walls (5*a*) and second side walls (5*b*) are interconnected and extend from the base wall (4), which tray is filled with said cartons, and an outer envelope which outer envelope is provided with a closure and in which outer envelope the tray filled with said cartons is accommodated, the improvement wherein the outer envelope is a wrapper (16) which is folded about parallel folding lines (11) and is wrapped only around the base wall (W), around the first side walls of the tray (3) and around sides (7) of each of the cartons (1) facing away from the base wall and which encloses the tray (3) and the cartons (1) with a clamping force and wherein the closure comprises a first end portion (12) of the envelope (10) with teeth (13) and a second end portion (14) with a forward projecting tongue (15), which tongue (15) projects between the teeth (13) and the tongue (15) when the teeth (13) lie inside the wrapper (10).

6. The packing unit of claim 5 wherein a second tray (3') filled with cartons (1') is present on the cartons (1) of the tray (3) in the wrapper (10).

7. A packing unit as claimed in claim 5, characterized in that the teeth (13) extend to an adjacent folding line (11) of the wrapper (10).

8. A packing unit as claimed in claim 7, wherein the tongue (15) is shorter than the teeth (13).

9. A packing unit as claimed in claim 7, wherein the tongue (35) has a portion (35*a*) which widens towards the second end portion (34) beyond interspacing present between the teeth (33).

10. A packing unit as claimed in claim 5 characterized in that the tongue (15) is shorter than the teeth (13).

11. A packing unit as claimed in claim 10, wherein the tongue (35) has a portion (35*a*) which widens towards the second end portion (34) beyond the interspacing between the teeth (33).

12. A packing unit as claimed in claim 5 characterized in that the tongue (35) has a portion (35*a*) which widens towards the second end portion (34) beyond the interspacing between the teeth (33).

13. A packing unit as claimed in claim 5, wherein the closure is present in a surface remote from the base wall (4) of the tray (3).

14. A packing unit as claimed in claim 5, wherein a seal (42) is present over the closure.

15. A packing unit as claimed in claim 14, characterized in that the first side walls (45*a*) and the wrapper (30) have projecting portions (45') and recesses (40) which engage one another.

16. A packing unit as claimed in claim 15, characterized in that the second side walls (45*b*) have flaps (45') which grip around the first side walls (45*a*) and are fastened thereto, and in that the wrapper (30) has recesses (40) cooperating with these flaps.

17. A packing unit as claimed in claim 16, characterized in that the recesses (40) comprise cut-out tongues (39).

18. A packing unit as claimed in claim 17, characterized in that the tongues (39) are flattened.

* * * * *

UNITED STATES PATENT AND TRADEMARK OFFICE

CERTIFICATE OF CORRECTION

PATENT NO. : 5,555,979
DATED : September 17, 1996
INVENTOR(S) : Frank J. Baas and Peter G.J. Vos It is certified that error appears in the above-identified patent and that said Letters Patent is hereby corrected as shown below:

Column 12,
Line 46, change "(W)" to -- (3) --.
Line 57, delete "(1)" to -- (1') --.

Signed and Sealed this

Twenty-ninth Day of October, 2002

*Attest:*

*Attesting Officer*

JAMES E. ROGAN
*Director of the United States Patent and Trademark Office*